US007588155B2

(12) United States Patent
Williams

(10) Patent No.: US 7,588,155 B2
(45) Date of Patent: Sep. 15, 2009

(54) BEVERAGE CONTAINER CLOSURE

(75) Inventor: Charles L. Williams, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 1035 days.

(21) Appl. No.: 10/138,088

(22) Filed: May 3, 2002

(65) Prior Publication Data

US 2002/0162818 A1 Nov. 7, 2002

Related U.S. Application Data

(60) Provisional application No. 60/288,940, filed on May 4, 2001.

(51) Int. Cl.
*B65D 41/34* (2006.01)
*B65D 41/04* (2006.01)

(52) U.S. Cl. ..... 215/343; 215/349; 215/252; 215/DIG. 1

(58) Field of Classification Search ..... 215/341, 215/343, 349, DIG. 1, 252, 344
See application file for complete search history.

(56) References Cited

U.S. PATENT DOCUMENTS 2,752,059 A * 6/1956 Schneider ..... 215/DIG. 1
2,768,762 A * 10/1956 Guinet ..... 215/320
2,901,139 A * 8/1959 Isele-Aregger ..... 215/345
3,033,407 A * 5/1962 Isele-Aregger ..... 215/328
3,051,342 A * 8/1962 Garcia- Paniagua ..... 215/342
3,074,579 A * 1/1963 Miller ..... 215/344
3,095,991 A * 7/1963 Paniagua ..... 215/303
3,195,754 A * 7/1965 Brockett ..... 215/328
3,215,297 A * 11/1965 Acton et al. ..... 215/343
3,628,704 A * 12/1971 Corsette ..... 222/513
4,360,114 A * 11/1982 Owens ..... 215/329
4,379,512 A * 4/1983 Ohmi et al. ..... 215/327
4,415,096 A * 11/1983 Ohmi ..... 215/343
4,429,802 A 2/1984 Marks
4,463,863 A * 8/1984 Imagawa et al. ..... 215/343
4,488,676 A 12/1984 Halliday
4,531,649 A * 7/1985 Shull ..... 215/232
4,625,875 A 12/1986 Carr et al.
4,658,976 A * 4/1987 Pohlenz ..... 215/252
4,658,977 A * 4/1987 Crisci ..... 215/256

(Continued)

FOREIGN PATENT DOCUMENTS

GB 2235186 A * 2/1991

OTHER PUBLICATIONS

Prior art Obergurg Engineering AG literature for "Plastic Liner Moulding Machine, Type KDP for the lining of standard caps and wide mouth closures", one page.

*Primary Examiner*—Robin Hylton
(74) *Attorney, Agent, or Firm*—Barnes & Thornburg LLP

(57) ABSTRACT

A beverage container closure includes a cap and a monolithic cap liner having concentric first and second seal rings coupled to the cap. The concentric first and second seal rings are adapted to mate with an annular rim provided on the neck of a beverage container and formed to include an open mouth to allow liquids to flow through the neck into and out of the beverage container. At least one of the seal rings is splayed relative to the annular rim during installation of the cap on the container neck to form a seal between the cap and the beverage container.

41 Claims, 6 Drawing Sheets

U.S. PATENT DOCUMENTS 4,667,839 A * 5/1987 Crisci ..... 215/256
4,741,447 A 5/1988 John
4,744,481 A 5/1988 Morgan, Jr.
4,878,589 A 11/1989 Webster et al.
5,042,680 A 8/1991 Argudo et al.
5,213,224 A 5/1993 Luch
5,415,306 A * 5/1995 Luch et al. ..... 215/256
5,553,727 A 9/1996 Molinaro
5,762,218 A 6/1998 Sachau
5,769,255 A * 6/1998 Ohmi et al. ..... 215/341
5,979,690 A 11/1999 Hartley

* cited by examiner

BEVERAGE CONTAINER CLOSURE

This application claims priority under 35 U.S.C. 119(c) to U.S. Provisional Application Serial No. 60/288,940, filed May 4, 2001, which is expressly incorporated by reference herein.

BACKGROUND AND SUMMARY

The present disclosure relates to a closure for a beverage container and particularly to a closure configured to close an open mouth formed in a threaded neck of a beverage container. More particularly, the present disclosure relates to a "snap-on, screw-off" closure for the neck of a beverage container.

Milk, juice, and other beverages are dispensed into jugs or containers at a bottling plant. A closure is then mounted on the container neck to close a liquid inlet/outlet opening formed in the container neck. Closures are sized and shaped to mate with container necks to minimize leakage of liquid from a closed container during shipment of filled containers from a bottling plant to a wholesale or retail store.

Some beverage containers, such as one gallon milk or orange juice jugs, are extrusion blow-molded using a polyethylene plastics material. Other beverage containers of the type used to store "sport" drinks are stretch blow-molded using a PET plastics material. In most cases, external threads are formed on the open-mouth necks of these containers to mate with a container closure formed to include mating internal threads.

Container closures are usually made of low-density polyethylene (LDPE) and configured to be snapped onto the neck using a capping machine at the bottling plant and screwed on and off the neck by a consumer at home or elsewhere. Such "snap-on, screw-off" style closures often include many fine interior threads with many separate thread leads to enable a bottler to close the open mouth formed in the container neck by applying downward pressure on the closure to "snap" it into place on the neck of a filled container. Nevertheless, a consumer is able to twist and unscrew the threaded closure to remove it from the threaded neck of the container to access the liquid in the container.

In accordance with the present disclosure, a beverage container closure comprises a cap adapted to be coupled to an open-mouth neck of a beverage container and a monolithic cap liner coupled to an interior surface of the cap. The cap liner includes concentric seal rings adapted to engage an annular rim provided on the beverage container neck to establish a sealed connection with the annular rim once the cap is installed on the container neck to close the open mouth formed in the container neck. At least one of the seal rings is splayed relative to the annular rim during installation of the cap on the container neck to form a seal between the cap and the beverage container.

Additional features of the present disclosure will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
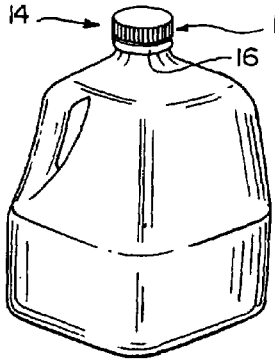
FIG. 1 is a perspective view of a closure mounted on a neck of a container.
Figure 2:
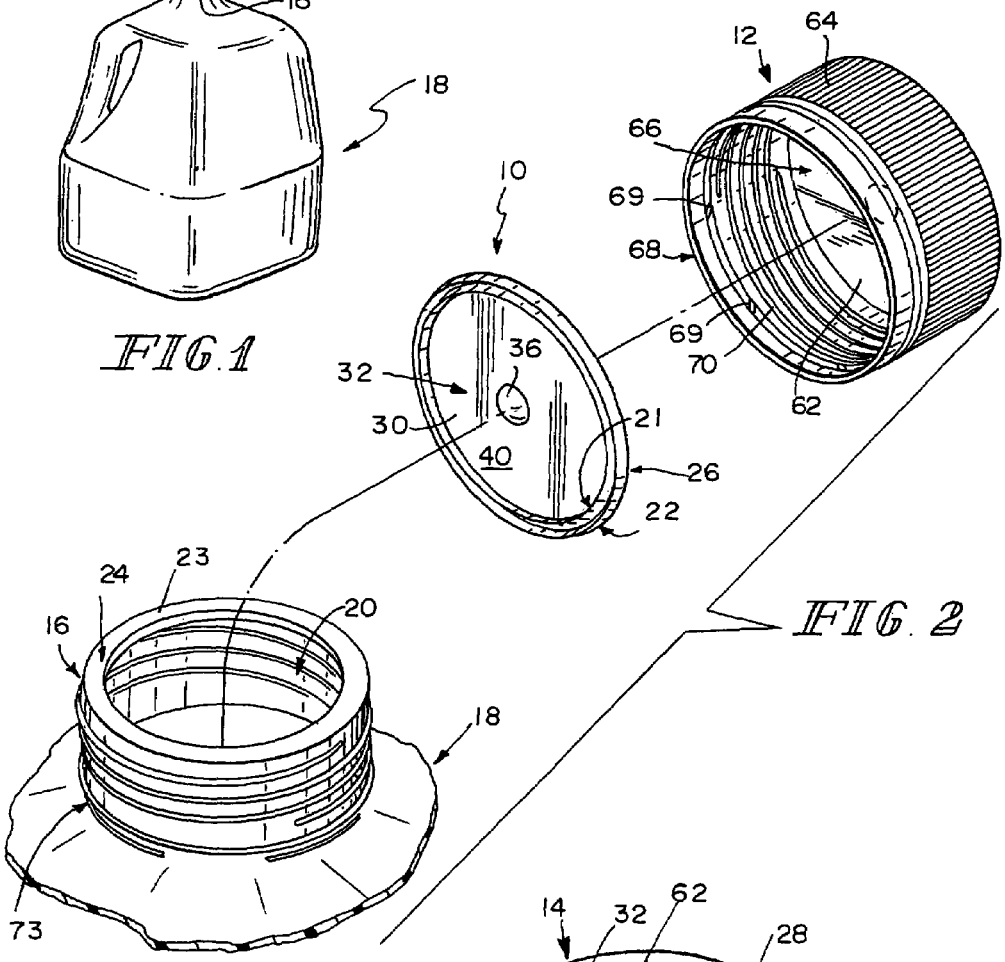
FIG. 2 is an exploded perspective assembly view showing a round monolithic cap liner sized to fit into an interior region formed in a cap and mate with an annular rim formed in the container neck when the cap is coupled to the container neck as shown, for example, in FIG. 3.
Figure 3:
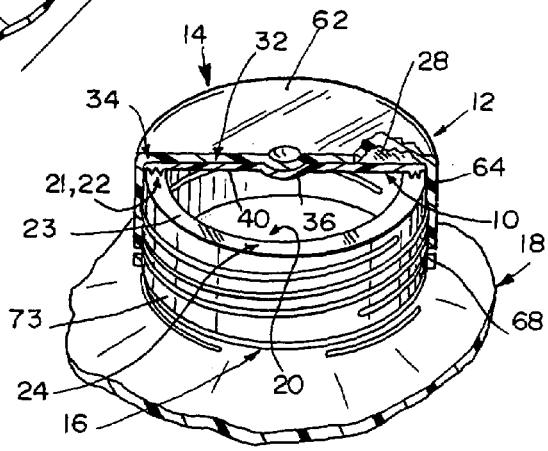
FIG. 3 is a perspective view similar to FIG. 2 showing use of the cap to retain the monolithic cap liner in a position closing an open mouth formed in the container neck and establishing an annular seal with the annular rim formed in the container neck to block leakage of liquid from the container through the open mouth when the cap is coupled to the container neck.
Figure 12:
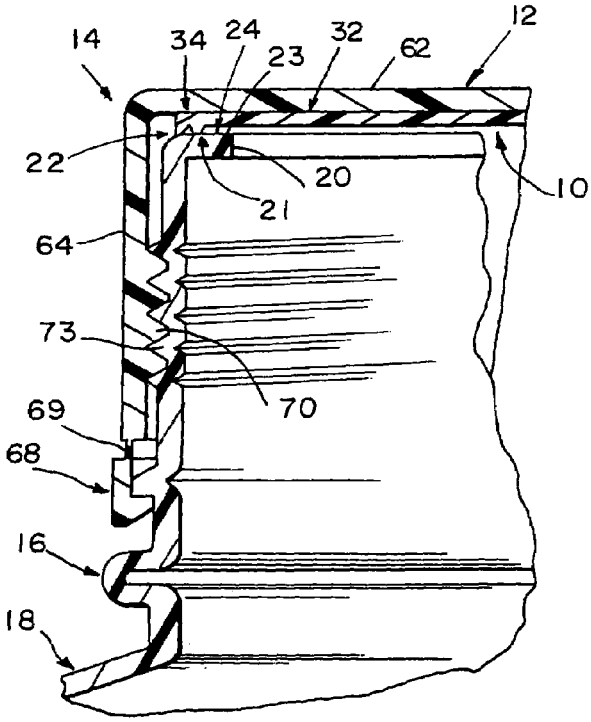
FIG. 12 is a partial sectional view similar to FIG. 11 showing retention of the monolithic cap liner in a sealed mouth-closing position on the annular rim of the container neck once the cap has been coupled to the container neck.

A cap liner 10 is coupled to an inner portion of a cap 12 to provide a beverage container closure 14 as suggested, for example, in FIGS. 1-3. Closure 14 mounts on a neck 16 of a container 18 to close an open mouth 20 formed in neck 16. Cap liner 10 includes concentric first and second seal rings 21, 22 that contact an upwardly facing substantially flat surface 23 of an annular rim 24 included in neck 16 to establish an "annular seal" therebetween when cap 12 is coupled to neck 16 (as shown in FIGS. 1, 3, and 12) so that leakage of liquid (not shown) from container 18 through open mouth 20 is blocked. mouth 20 is blocked.

Figure 4:
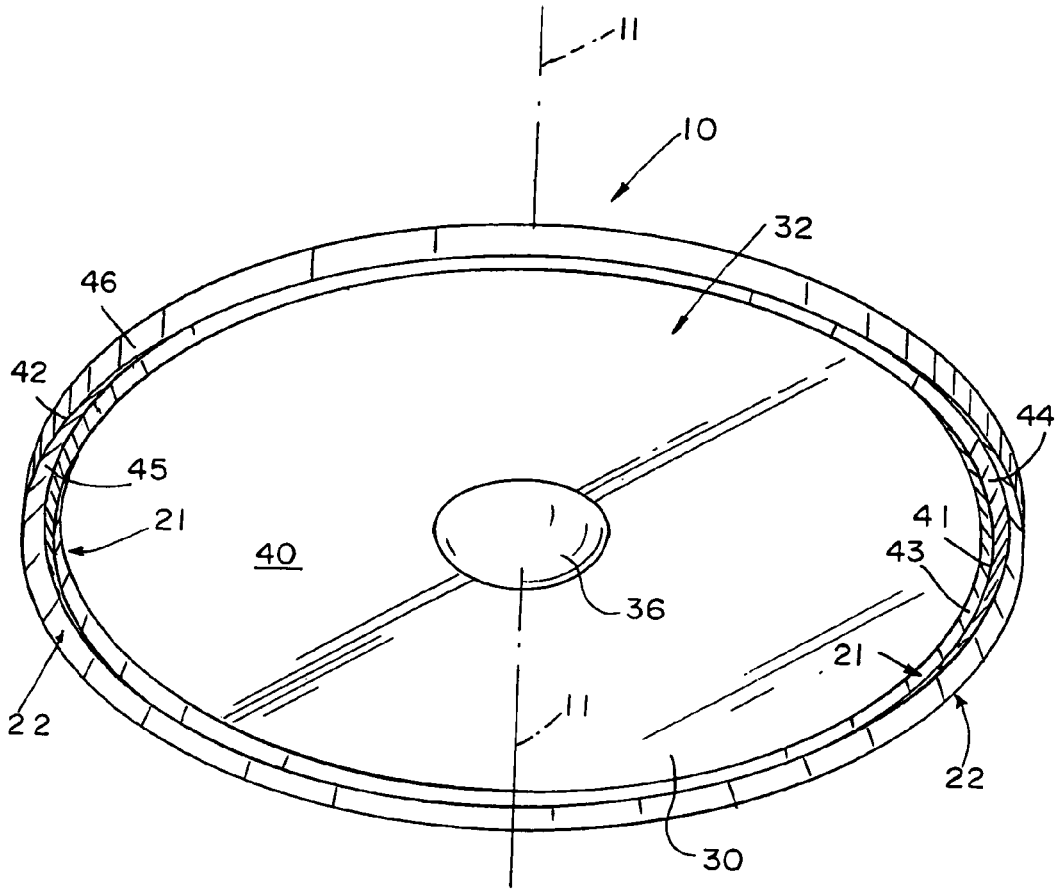
FIG. 4 is an enlarged, perspective view of the underside of the monolithic cap liner of FIGS. 2 and 3 before the cap liner is inserted into and attached to the cap showing concentric first and second seal rings included in the cap liner.
Figure 5:
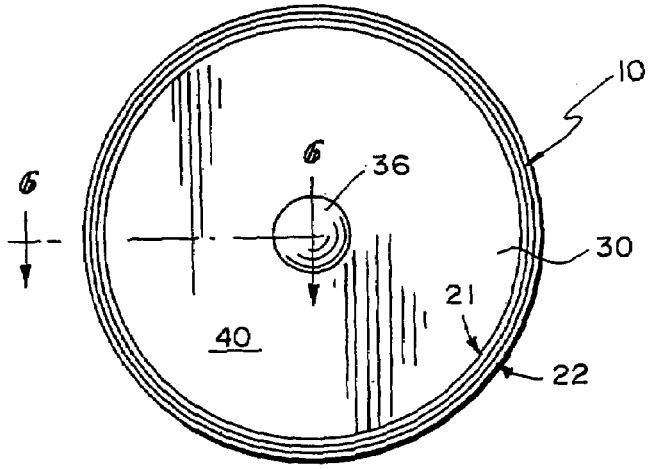
FIG. 5 is a bottom view of the monolithic cap liner of FIGS. 2-4.
Figure 6:
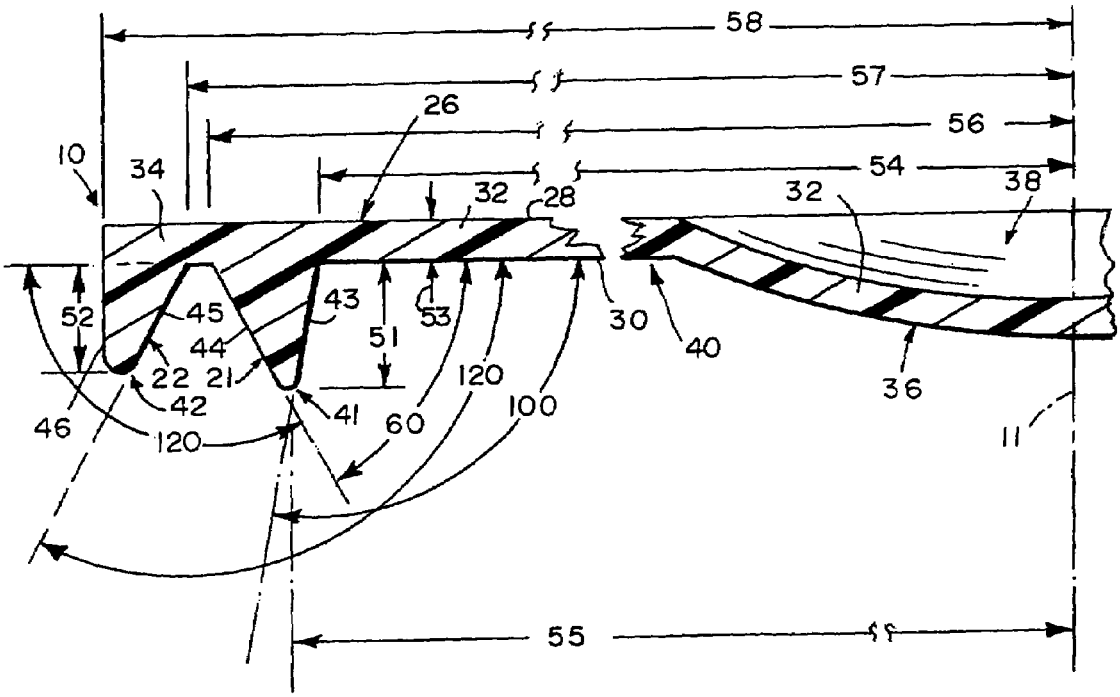
FIG. 6 is an enlarged sectional view taken along line 6-6 of FIG. 5 showing cross-sectional views of a first embodiment of first and second seal rings.
Figure 7:
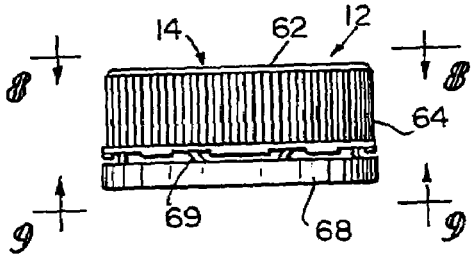
FIG. 7 is a side elevation view of the closure of FIGS. 1 and 3.
Figure 8:
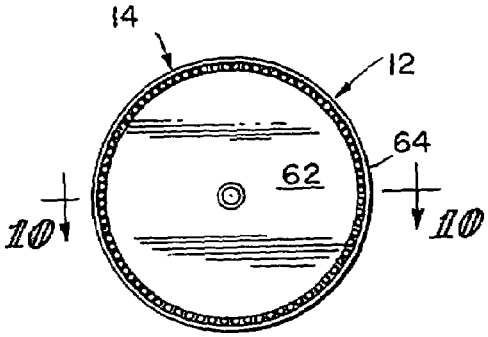
FIG. 8 is a top plan view of the closure of FIG. 7.
Figure 9:
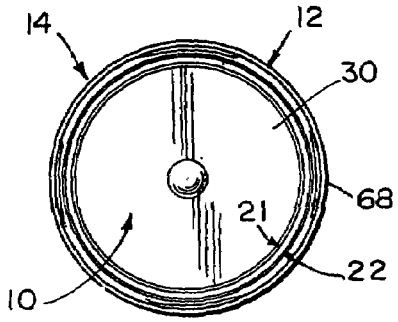
FIG. 9 is a bottom view of the closure of FIG. 7 showing the monolithic cap liner in the cap.

Cap liner 10 includes a mount 26 having a top surface 28 arranged to mate with cap 12 and an opposite bottom surface 30 arranged to support the concentric first and second seal rings 21, 22 as suggested in FIGS. 4-6. In the illustrated embodiment, mount 26 is shaped to provide a round disk. Also, in the illustrated embodiment, cap liner 10 is monolithic and made of a plastics material as suggested in FIG. 6.

Mount 26 of cap liner 10 includes a round inner web 32 and an annular outer web 34 surrounding round inner web 32 as suggested in FIGS. 3 and 6. Concentric first and second seal rings 21, 22 depend from annular outer web 34 as suggested in FIG. 6. Inner web 32 includes an outer peripheral portion terminating at first seal ring 21 to cause first seal ring 21 to surround inner web 32. Inner web 32 includes a central dome 36 formed to include a dome receiver cavity 38 having an opening in top surface 28. Inner web 32 also includes a web membrane 40 arranged to surround central dome 36 and extend radially outwardly from central dome 36 to first seal ring 21.

First seal ring 21 includes a wide annular base appended to annular outer web 34 of mount 26 and a narrower annular crest 41 positioned to lie in spaced-apart relation to annular outer web 34 as shown in FIG. 6. First seal ring 21 also includes an inclined radially inwardly facing surface 43 that is arranged to cooperate with bottom surface 30 of web membrane 40 of inner web 32 to define an included angle 100 of about 100° (e.g., 99.727°). In the illustrated embodiment, surface 43 has a first frustoconical shape. First seal ring 21 also includes an inclined radially outwardly facing surface 44 that is arranged to cooperate with bottom surface 30 of web membrane 40 of inner web 32 to define an included angle 60 of about 60° (e.g., 60.266°). In the illustrated embodiment, surface 44 has a second frustoconical shape. Annular crest 41 is rounded in cross-section and arranged to interconnect the inclined radially inwardly and outwardly facing surfaces 43, 44 as suggested in FIGS. 4 and 6.

Second outermost seal ring 22 includes a wide annular base appended to annular outer web 34 of mount 26 and a narrower annular crest 42 positioned to lie in spaced-apart relation to annular outer web 34 as shown in FIG. 6. Second seal ring 22 also includes an inclined radially inwardly facing surface 45 that is arranged to cooperate with bottom surface 30 of web membrane 40 of inner web 32 to define an included angle 120 of about 120° (e.g., 119.744°). In the illustrated embodiment, surface 45 has a frustoconical shape. Second seal ring 22 also includes a cylindrical radially outwardly facing surface 46. Annular crest 42 is rounded in cross-section and arranged to interconnect surfaces 45 and 46 as suggested in FIGS. 4 and 6.

As shown best in FIG. 6, first seal ring 21 has a profile height 51 extending from bottom surface 30 of web membrane 40 of inner web 32 to annular crest 41. In the illustrated embodiment, the profile height 51 is about 0.040 inch (1.02 mm). Second seal ring 22 has a profile height 52 extending from bottom surface 30 of web membrane 40 of inner web 32 to annular crest 42. In the illustrated embodiment, the profile height 52 is about 0.030 inch (0.76 mm). Thus, profile height 51 of first seal ring 41 is greater than profile height 52 of second seal ring 42.

Various dimensions associated with cap liner 10 are shown in FIG. 6. The illustrated cap liner 10 is sized for use in closing a container neck having a 38 mm liquid inlet/outlet opening. For containers of different size, the dimensions of cap liner 10 (and cap 12) shall be adjusted proportionately to match the size of the selected liquid inlet/outlet opening in the container neck. Thickness 53 of mount 26 is about 0.0145 inch (0.368 mm). Cap liner 10 has a center line 11 shown in FIGS. 4 and 6. Dimension 54 is about 0.609 inch (15.468 mm); dimension 55 is about 0.620 inch (15.748 mm); dimension 56 is about 0.646 inch (16.408 mm); dimension 57 is about 0.651 inch (16.535 mm); and dimension 58 is about 0.679 inch (17.246 mm).

Cap liner 10 is formed from an elastomeric material with a preferred Shore A durometer hardness of 58±3, although materials with hardness readings ranging from 50 to 65 are suitable. The use of substantially harder materials will impair the reliability of the seal since harder materials may not deform sufficiently which can cause deformation of the cap skirt during forceful tightening (i.e., torquing). The preferred cap liner material is sold under the trade name POLY SEAL 555 by DSChemie, Bremen, Germany. That material is a blend of a natural rubber base, HDPE, EVA for improved adhesion to the cap, and an amide wax for improved performance in cooler temperature ranges. Examples of suitable materials for use in cap liner 10 include synthetic or natural rubber, ethylene vinyl alcohol (EVA), polyethylene teraphthalate, polyvinyl chloride, linear low-density polyethylene, polystyrene, thermoplastic elastomers, and/or soft polypropylene. Optionally, the material may be a laminate of one or more of such compounds of mixtures of one or more of such compounds. The sealing liners typically used for carbonated beverage containers have a Shore A durometer hardness reading between 85 and 95. Accordingly, such sealing liners are not suitable for use in the cap liner disclosed herein.

Cap liner 10 is formed using a compression molding method which includes extrusion of the sealer material onto the center of a cap through a pick-up nozzle. A sensor measures the gram weight of the sealer material extruded and provides a signal to the pick-up nozzle to cease the sealer fluid flow at a predetermined level, typically between 0.440 to 0.460 grams, for a 38 mm opening cap. The cap and the material cools during transportation via conveyor to a compression station. Just prior to compression, the sealer material has cooled to about 215° C. and is semi-solid. A compression punch is then brought down upon the sealer material under high pressure. The compression punch has a profile which is machined to be a mirror image of the cap liner 10 having a plurality of sealing surfaces as described above. The sealing material adheres to cap 12 without use of adhesives or any further addition of heat to cap liner 10 or cap 12. It is within the scope of this disclosure to adhere cap liner 10 to cap 12 so as to cause cap liner 10 to hold fast or stick onto cap 12 by or as if by gluing, suction, grasping, or fusing. In a further quality control step, air pressure of 2 bar is sent over cap 12 and cap liner 10 to ensure the integrity of the bond between cap liner 10 and cap 12. The preferred apparatus for performing this method of forming cap liner 10 is in the KDP50-24 Plastic Liner Molding Machine sold by Oberburg Enbineering AG, Ementalstrasse 137, CH-3414, Oberburg, Switzerland.

It is contemplated that cap liner 10 is appropriate for large-mouthed containers for use with non-carbonated fluids, such as milk or fruit juice. The "double" seal ring configuration of cap liner 10 requires less compression of sealing rings 21, 22 prior to forming a stable seal than single-ridge sealing liners used previously for such containers. This feature provides a lower torque requirement for complete closure and formation of a reliable seal between cap 12 and container neck 16. The reduced compression required to form a seal provided by cap liner 10 also helps prevent an "over-torque" situation since the cap threads of cap 12 are prevented from traveling too far down the length of the neck threads of neck 16 so that they pass or nearly pass the neck threads and can easily jump over them. The lowering of the torque requirement for sealing of closure 14 simplifies the container filling and capping procedure. The broader the range between the amount of torque needed for a reliable seal and the torque that would cause an over-torque situation is defined as the operational range of torque for a capping apparatus. Control of the torque applied to the container in production has been a problem in the past which cap liner 10 overcomes by maximizing the operational torque range. For cap liner 10, the sealing torque is preferably about 8 inch-pounds and varies, for example, between 8 and 10inch-pounds The over-torque failure of the cap is 18 inch pounds and is preferably between 16 and 24 inch-pounds.

It is preferred that first and second seal rings 21, 22 are tapered so that each ring has a wider base portion and a narrower sealing portion (when viewed in cross-section) so that the seal rings initially deform more readily during contact with upwardly facing surface 23 of annular rim 24 of container neck 16 of the lip 70 and then deforms less readily after the initial contact. It is also preferred that the inner first seal ring 21 has a higher crest than the outer second seal ring 22 so that upwardly facing surface 23 of annular rim 24 initially contacts crest 41 and radially outwardly facing surface 44 of the inner first seal ring 21. As a result of this preferred configuration, the inner first seal ring 21 first contacts upwardly facing surface 23 of annular rim 24 and begins to deform inwardly toward the central axis of the container neck 16 and the outer second seal ring 22 next contacts upwardly facing surface 23 of annular rim 24 and is deformed substantially downwardly. The "splayed" deformation of the inner first seal ring 21 is best shown (in slightly exaggerated form) in FIG. 12. In production-like settings, it has been observed that the inner first seal ring 21 becomes splayed away from the central axis of the container neck 16 in a small percentage of installed closures 14. Although such an outwardly preferred splayed seal is not preferred, it has been observed to provide a reliable seal. The splayed deformation of at least one of first and second seal rings 21, 22 helps ensure that a reliable seal is formed even when the neck 16 of the container 18 is outside of specified dimension tolerances.

Additional cap liner designs are illustrated in FIGS. 13-16, which illustrations are similar to the cross-sectional view of cap liner 10 provided in FIG. 6. In each case, the "profile height" of the radially inner seal ring is greater than the profile height of the adjacent radially outer seal ring.

Figure 13:
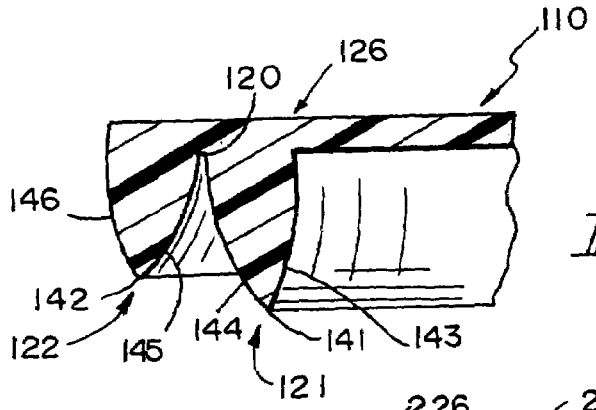
FIGS. 13-16 show partial cross-sectional views of other embodiments of first and second seal rings in a monolithic cap liner in accordance with the present disclosure.

In the embodiment shown in FIG. 13, cap liner 110 includes mount 126 and concentric first and second seal rings 121 122. Each of surfaces 143, 144, 145, 146 has a convex cross-sectional shape as shown, for example, in FIG. 13. Radially inwardly facing surface 145 of second seal ring 122 is arranged to lie in confronting relation to and merge with radially outwardly facing surface 144 of first seal ring 121 at circular junction 120. First seal ring 121 includes annular crest 141 and second seal ring 122 includes annular crest 142.

Figure 14:
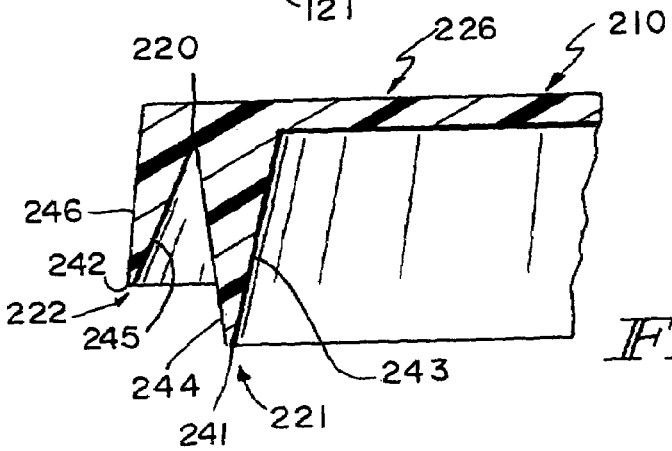

In the embodiment shown in FIG. 14, cap liner 210 includes mount 226 and concentric first and second seal rings 221, 222. First seal ring 221 has a cross-sectional shape in the form of an isosceles triangle and second seal ring 222 has a cross-sectional shape in the form of a right triangle. Each of surfaces 243, 244, 245 has a frustoconical shape and surface 246 has a cylindrical shape. Radially inwardly facing surface 145 of second seal ring 222 is arranged to lie in confronting relation to and merge with radially outwardly facing surface 244 of first seal ring 222 at circular junction 220. First seal ring 221 includes annular crest 241 and second seal ring 222 w includes annular crest 242.

Figure 15:
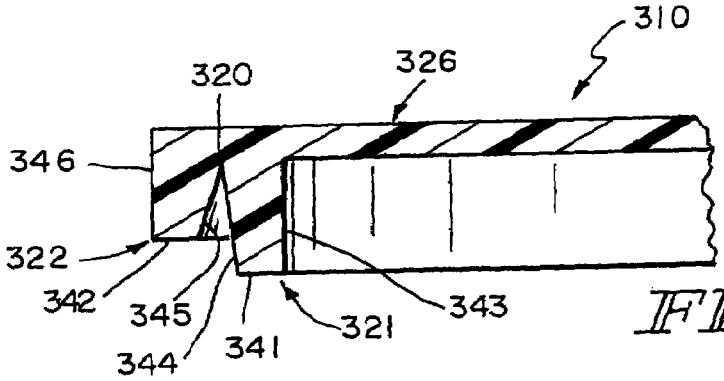

In the embodiment shown in FIG. 15, cap liner 310 includes mount 326 and concentric first and second seal rings 321, 322. First seal ring 321 includes a flat annular crest 341 and second seal ring 322 includes a flat annular crest 342. First seal ring 321 includes a cylindrical radially inwardly facing surface 343 and a frustoconical radially outwardly facing surface 344. Second seal ring 322 includes a cylindrical radially outwardly facing surface 346 and a frustoconical radially inwardly facing surface 345 that is arranged to lie in confronting relation to and merge with surface 344 of first seal ring 321 at circular junction 320.

Figure 16:
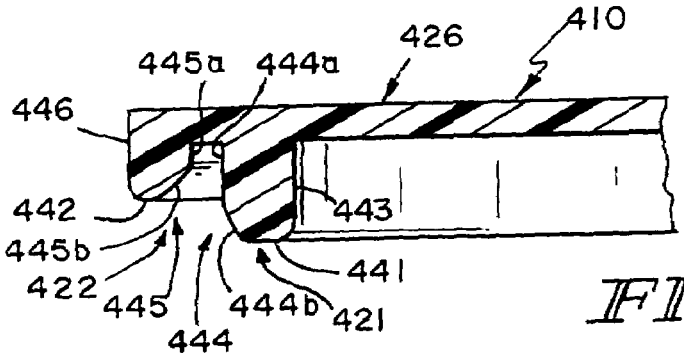

In the embodiment shown in FIG. 16, cap liner 410 includes mount 426 and concentric first and second seal rings 421, 422. First seal ring 421 includes annular crest 441 and second seal ring 422 includes annular crest 442. First seal ring 421 includes a cylindrical radially inwardly facing surface 443 and second seal ring 422 includes a cylindrical radially outwardly facing surface 446. A radially outwardly facing surface 444 of first seal ring 421 includes a first portion 444*a* having a cylindrical shape positioned to lie adjacent to mount 426 (e.g., disk) and a second portion 444*b* having a frustoconical shape positioned to lie between first portion 444*a* and annular crest 441 and in spaced-apart relation to mount 426. A radially inwardly facing surface 445 of second seal ring 422 includes a first portion 445*a* having a cylindrical shape positioned to lie adjacent to mount 426 (e.g., disk) and a second portion 445*b* having a frustoconical shape positioned to lie between first portion 445*a* and annular crest 442 and in spaced-apart relation to mount 426. An annular surface extends between first portion 444*a* and first portion 445*a* as shown in FIG. 16.

Cap 12 includes a top wall 62 and an annular skirt 64 depending from top wall 62 to form an interior region 66 as shown, for example, in FIGS. 2 and 10-12. Cap 12 also includes a tamper band 68 coupled to annular skirt 64 by means of frangible bridges 69.

In the illustrated embodiment, annular skirt 64 of cap 12 has a total of four threads 70 with four leads 71 formed in the inner surface 72 of annular skirt 64. In this embodiment, the multiple threads and multiple thread leads assist in providing skirt 64 with sufficient flexibility to provide a snap-on/twist-off capability. The multiple threads 70 are preferably sized, angled, and pitched so that they can slide over container neck threads 73 in response to downward axial pressure applied during bottling. A wide variety of numbers of threads having differing length, height, pitch, and angle of opposite faces may be used in skirt 64. Preferably, for snap-on/twist-off skirts, the number of threads is between four and eight, the height of the threads is about 0.027 inch (0.685 mm) and between about 0.025 inch (0.635 mm) to about 0.035 inch (0.889 mm); the pitch of the threads is preferably 0.047 inch (1.193 mm) and varies from about 0.045 (1.143 mm) to about 0.060 (1.524 mm); the angle defined by opposite faces 70*a*, 70*b* of the threads 70 is preferably 30° and varies from about 25° to about 40°; and each thread 70 preferably extends circumferentially about 220° around the cylindrical inner surface of annular skirt 64, but may extend circumferentially between 180° and 240°.

Annular skirt 64 is preferably made of high-density polyethylene (HDPE") material and formed by a conventional injection-molding process. Preferably, the HDPE cap 12 is made from an HDPE resin having a density of about 0.95. It is further contemplated that caps 12 using cap liner 10 may be formed from LDPE, a blend or copolymer of LDPE and HDPE, or other lightweight, inexpensive thermoplastic materials suitable for injection-molding. The use of HDPE material, however, allows the use of a substantially thinner annular wall for annular skirt 64 and therefore requires significantly less material to form than the annular wall of conventional LDPE caps. Annular skirts 64 designed in accordance with the disclosure herein are flexible enough to jump threads during application of downward axial pressure in the course of bottling and have improved resistance to over-torque, "false positive" tamper evidence, as well as deformation during rough handling. The thickness of annular skirt 64 is defined as one-half of the distance between the exterior wall dimension and the thread major dimension and is preferably about 0.027 inch (0.685 mm). This reduction in the thickness of the annular wall 23 results in a cap which may weigh as much as 27% less than a conventional skirt made of LDPE of similar design. The result is an HDPE skirt which preferably weighs as little as 0.73 grams (excluding the weight of the tamper-evident band and sealing liner). In contrast, conventional LDPE cap skirts of similar design typically weighted at least 0.93 grams.

As shown in FIGS. 1 and 2, annular skirt 64 has a number of vertical ribs 65 formed on the exterior surface of annular skirt 64. The ribs 65 preferably extend about 0.014 inch (0.355 mm) radially outwardly from the exterior surface of annular skirt 64 to a flattened rib outer surface. Ribs 65 have angled side surfaces which are preferably angled at about 60° from one another. The ribs 65 are preferably slightly drafted about 2° from their base to their upper end to assist in removal from an injection mold. The ribs 65 provide a high-friction surface to assist in gripping skirt 64 of cap 12 when it is rotated during bottling or opening/closing by the end user. Preferably, the skirt 64 has a total of 75 ribs on the exterior surface of annular skirt 64, but may have from about 70 to about 100 ribs. Many prior cap designs included over 100 ribs on the exterior of the skirt. Removal of 25 ribs can provide up to an additional 10% decrease in skirt weight while maintaining a suitable high-friction surface on the exterior surface of skirt 64. By combining the "reduced ribs" feature and "thin walls" feature, caps with HDPE skirts weighing as little as 0.73 grams (excluding the weight of the tamper-evident band and sealing liner) have been formed. The HDPE cap 12 with cap liner 10 exhibits maximum torque resistance, resistance to deformation, and tamper evidence performances.

Figure 10:
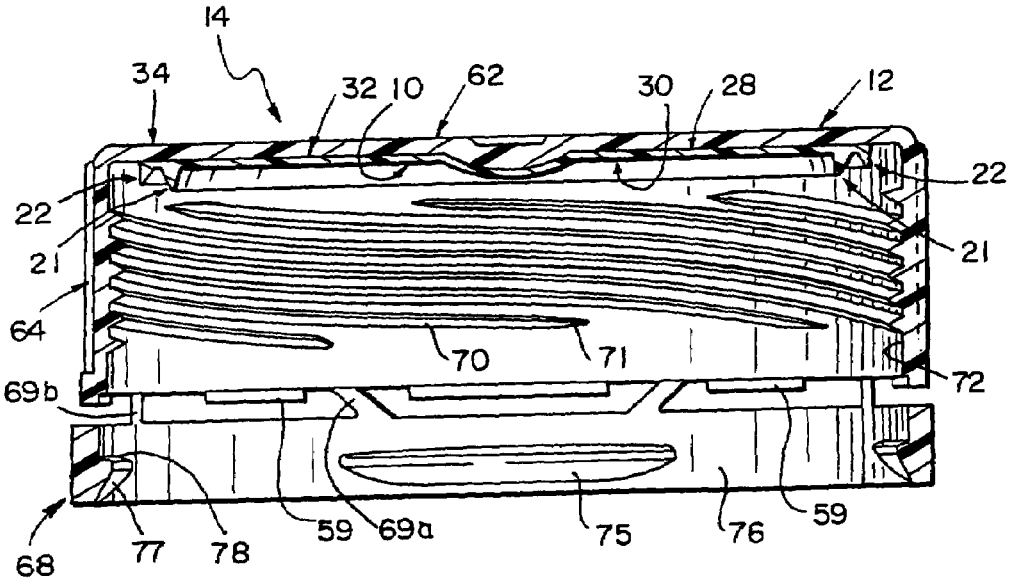
FIG. 10 is an enlarged sectional view of the closure taken along line 10-10 of FIG. 8 showing the monolithic cap liner coupled to a downwardly facing interior surface of the top wall of the cap to cause the concentric first and second seal rings to extend downwardly away from the top wall of the cap.
Figure 11:
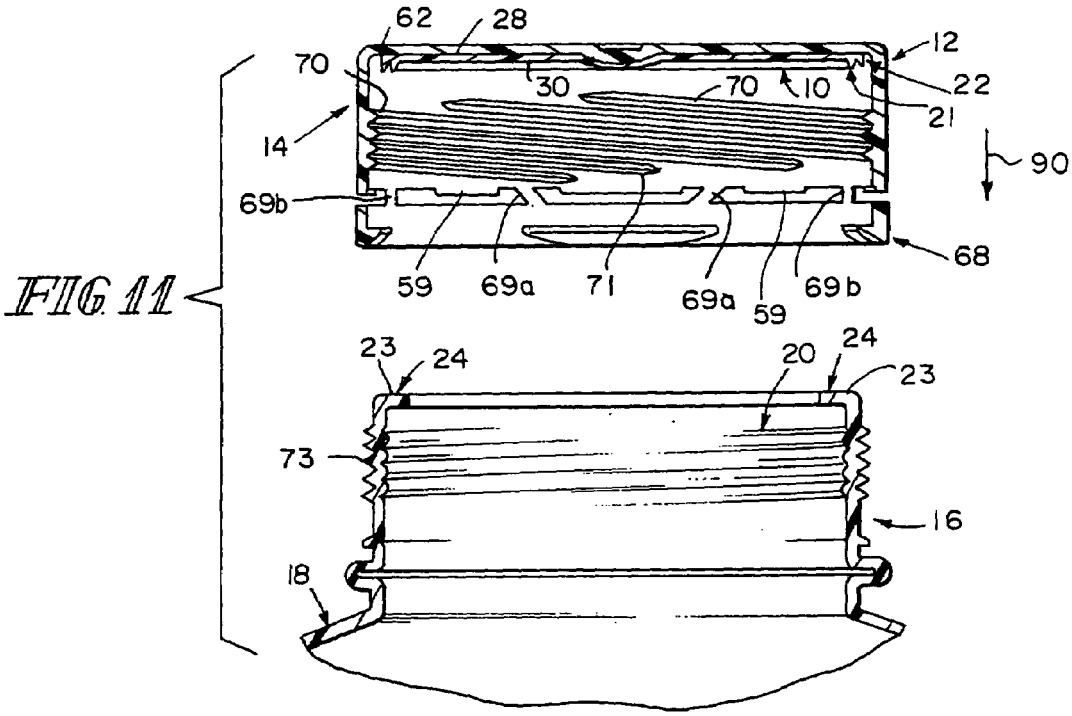
FIG. 11 is a sectional view showing a closure including a cap and a monolithic cap liner as the closure is being lowered toward a container to mate with a threaded neck of the container.

As can be best seen in FIGS. 2, 10, and 11, frangible bridges 69 include both angled bridges 69*a* and vertical bridges 69*b* connecting annular skirt 64 to the tamper-evident band 68. Preferably, band 68 included at least eight bridges, including two pairs of angled bridges and two pairs of vertical bridges, although other combinations of bridges may be used. The use of HDPE material provides frangible bridges which are significantly more resistant to inadvertent breaking or stretching which can lead to "false positive" evidence of tampering than bridges formed from LDPE. The lower edge of annular skirt 64 is defined by a shelf extending axially outwardly so that it has a slightly greater exterior diameter than the remainder of annular skirt 64. A plurality of spaced-apart pads 59 extend down from the lower edge of annular skirt 64. The outer diameter of pads 59 preferably match the outer diameter of the band 68. The pads 59 provide a surface for the upper edge of the band 68 to bear against when downward axial pressure is applied to the cap during bottling and when upward axial pressure is applied to the bottom edge of the band 68 to assist in ejection of the skirt 64 from the injection mold.

The exterior and interior diameters of the band 68 are slightly larger than those of annular skirt 64 (other than at the pads 59) to allow the band 68 to fit over the annular rim 24 on the container neck 16. The band 68 has a plurality of ridges 75 formed on its interior surface 76. The ridges 75 have an angled lower surface 77 and a bridge-severing surface 78 extending transversely from the interior surface 50. The lower surface 77 of the ridges 75 are angled to ease passage of the skirt 64 and band 68 over the rim 24 on neck 16 during the application of downward axial pressure on the cap 12 in the course of bottling. The bridge-severing surface 78 of the ridges 75 are designed to engage the rim 24 on the neck 16 of the container 18 when the cap 12 is twisted for removal. The engagement between the bridge-severing surface 78 and rim 24 on the neck 16 as the skirt 64 is lifted and rotated breaks the frangible bridges 69 so that the band 68 is retained on the neck 16 of the container 18. Although bridge-severing surface 78 is shown as being disposed on a series of spaced-apart ridges, it is contemplated that a continuous bridge-severing surface could be provided by use of a continuous rim extending transversely from the interior surface of the band 68, rather than spaced-apart ridges.

In accordance with the disclosure herein, a method is provided to establish a sealed connection between cap 10 and neck 16 of beverage container 18 to close open mouth 20 formed in container neck 16. First and second seal rings 21, 22 included in cap liner 10 are moved downwardly in direction 90 toward annular rim 24 formed in container neck 16 as suggested in FIG. 11. Such movement is accomplished by moving the cap 12 carrying cap liner 10 in direction 90 toward container neck 16. Thereafter, cap 10 is moved relative to container 18 to splay at least one (and perhaps both) of first and second seal rings 21, 22 relative to annular rim 24 upon contact of first and second annular rings 21, 22 with upwardly facing surface 23 of annular rim 24 to form a seal between cap 12 and beverage container 18. By providing concentric first and second seal rings 21, 22, a seal is established between cap 12 and container neck 16 in situations where container neck 16 is characterized by a poor quality neck finish owing, for example, to inconsistent extrusion blow molding of beverage container 18. "Primary" and "secondary" seals are effected by use of first and second seal rings 21, 22. As closure 14 is torqued about axis 11, both seal rings 21, 22 are splayed and compressed relative to upwardly facing surface 23 on annular rim 24 of container neck 16.

The invention claimed is:

1. A beverage container closure in combination with a beverage container comprising a beverage container including a mouth having an annular rim and a substantially flat top surface, a cap including a top wall and an annular skirt depending from the top wall, a monolithic cap liner including a mount coupled to the top wall, a first seal ring having a crest arranged to depend from the mount by a certain distance, and a second outermost seal ring having a crest arranged to depend from the mount by a lesser distance and surround the first seal ring, and the first and second seal rings spaced inwardly from the annular skirt at a distance that provides compressive sealing of the crests on the substantially flat top surface of the beverage container and wherein the first seal ring engages the top surface of the beverage container and is compressed by contact with the substantially flat top surface prior to the second seal ring contacting the substantially flat top surface of the beverage container.

2. The closure of claim 1, wherein the mount includes an inner web adhered to the top wall and the inner web includes an outer peripheral portion terminating at the first seal ring to cause the first seal ring to surround the inner web.

3. The closure of claim 2, wherein the top wall and the annular skirt cooperate to define an interior region of the cap, the top wall includes a central dome arranged to extend into the interior region and a flat interior surface arranged to surround the central dome of the top wall and extend radially outwardly from the central dome of the top wall to the annular skirt, the inner web includes a central dome formed to include a dome receiver cavity having an opening facing toward the top wall of the cap, the inner web further includes a web membrane arranged to surround the central dome of the inner web and extend radially outwardly from the central dome of the inner web to the first seal ring, and the inner web is arranged on the top wall of the cap to cause the central dome of the top wall to extend into the dome receiver cavity formed in the central dome of the inner web and to cause the web membrane to mate with the flat interior surface of the top wall.

4. The closure of claim 3, wherein the web membrane is adhered to the flat interior surface of the top wall.

5. The closure of claim 3, wherein the web membrane has a thickness of about 0.0145 inches (0.368 mm).

6. The closure of claim 2, wherein the first seal ring includes an inclined radially inwardly facing surface that is arranged to cooperate with the inner web to define an included angle of about 100° therebetween.

7. The closure of claim 2, wherein the first seal ring includes an inclined radially outwardly facing surface that is arranged to cooperate with the inner web to define an included angle of about 60° therebetween.

8. The closure of claim 2, wherein the second seal ring includes an inclined radially inwardly facing surface that is arranged to cooperate with the inner web to define an included angle of about 120° therebetween.

9. The closure of claim 2, wherein the first seal ring has a profile height extending from the inner web to a crest of the first seal ring, the second seal ring has a profile height extending from the inner web to a crest of the second seal ring, and the profile height of the first seal ring is greater than the profile height of the second seal ring.

10. The closure of claim 2, wherein the inner web has a thickness of about 0.0145 inch (0.368 mm) and the first seal ring has a profile height extending from the inner web to a crest of the first seal ring of about 0.040 inch (1.02 mm).

11. The closure of claim 9, wherein the second seal ring has a profile height extending from the inner web to a crest of the second seal ring of about 0.030 inch (0.76 mm).

12. The closure of claim 2, wherein the first seal ring includes an inclined radially inwardly facing surface that is arranged to cooperate with the inner web to define an included angle of about 100° therebetween, the first seal ring includes an inclined radially outwardly facing surface that is arranged to cooperate with the inner web to define an included angle of about 60° therebetween, the second seal ring includes an inclined radially inwardly facing surface that is arranged to cooperate with the inner web to define an included angle of about 120° therebetween, the first seal ring has a profile height extending from the round inner web to a crest of the first seal ring, the second seal ring has a profile height extending from the inner web to a crest of the second seal ring, and the profile height of the first seal ring is greater than the profile height of the second seal ring, and the inner web has a thickness of about 0.0145 inch (0.368 mm) and the first seal ring has a profile height extending from the inner web to a crest of the first seal ring of about 0.040 inch (1.02 mm).

13. The closure of claim 2, wherein the mount further includes an annular outer web having a surface arranged to extend between the first and second seal rings.

14. The closure of claim 13, wherein the first seal ring includes an inclined radially outwardly facing surface that is arranged to cooperate with the annular outer web to define an included angle of about 120° therebetween.

15. The closure of claim 13, wherein the second seal ring includes an inclined radially inwardly facing surface that is arranged to cooperate with the annular outer web to define an included angle of about 120° therebetween.

16. The closure of claim 2, wherein the inner web is round, the first seal ring surrounds the round inner web, the mount further includes an annular outer web arranged to surround the first seal ring and extend between the first and second seal rings, and the second seal ring surrounds the annular outer web.

17. The closure of claim 1, wherein the annular skirt includes an internal threaded portion adapted to mate with external threads on a container neck and the monolithic cap liner is positioned to lie between the top wall and the internal threaded portion of the annular skirt.

18. The closure of claim 1, wherein the first seal ring includes an inclined radially inwardly facing surface having a first frustoconical shape.

19. The closure of claim 18, wherein the first seal ring includes an inclined radially outwardly facing surface having a second frustoconical shape different from the first frustoconical shape.

20. The closure of claim 19, wherein the second seal ring includes an inclined radially inwardly facing surface having a third frustoconical shape different from each of the first and second frustoconical shapes.

21. The closure of claim 18, wherein the second seal ring includes an inclined radially inwardly facing surface having a selected frustoconical shape different from the first frustoconical shape.

22. The closure of claim 1, wherein the first seal ring includes separate inclined radially inwardly and outwardly facing surfaces, the second seal ring includes an inclined radially inwardly facing surface, and each of said surfaces has a frustoconical shape.

23. The closure of claim 22, wherein the first seal ring further includes an annular crest arranged to interconnect the inclined radially inwardly and outwardly facing surfaces of the first seal ring.

24. The closure of claim 22, wherein the second seal ring further includes a cylindrical radially outwardly facing surface.

25. The closure of claim 24, wherein the second seal ring further includes an annular crest arranged to interconnect the inclined radially inwardly facing surface of the second seal ring and the cylindrical radially outwardly facing surface of the second seal ring.

26. A beverage container closure and a beverage container comprising a beverage container having a neck with a substantially flat top surface a cap formed to include an interior region adapted to receive the neck of the beverage container therein and a monolithic cap liner located in the interior region and adhered to the cap, the monolithic cap liner includes a round disk having a top surface adhered to the cap, an opposite bottom surface, and an outer edge, a first seal ring having a crest and arranged to depend from the bottom surface of the round disk for a first distance, and a second outermost seal ring having a crest and arranged to depend from the bottom surface of the round disk by a lesser distance and surround the first seal ring, and wherein both seal ring crests are located inwardly with respect to the outer edge of the disk to provide compressive sealing to the substantially flat top surface of the beverage container and wherein the first seal ring engages the substantially flat top surface of the beverage container and is compressed by contact with the substantially flat top surface prior to the second seal ring contacting the substantially flat top surface of the beverage container.

27. The closure of claim 26, wherein the first seal ring includes an inclined radially inwardly facing surface having a first frustoconical shape.

28. The closure of claim 27, wherein the first seal ring includes an inclined radially outwardly facing surface having a second frustoconical shape different from the first frustoconical shape.

29. The closure of claim 28, wherein the second seal ring includes an inclined radially inwardly facing surface having a third frustoconical shape different from each of the first and second frustoconical shapes.

30. The closure of claim 27, wherein the second seal ring includes an inclined radially inwardly facing surface having a selected frustoconical shape different from the first frustoconical shape.

31. The closure of claim 26, wherein the first seal ring includes separate inclined radially inwardly and outwardly facing surfaces, the second seal ring includes an inclined radially inwardly facing surface, and each of said surfaces has a frustoconical shape.

32. The closure of claim 31, wherein the second seal ring further includes a cylindrical radially outwardly facing surface.

33. A beverage container closure and a beverage container comprising a beverage container having a neck with a substantially flat top surface a cap formed to include an interior region adapted to receive the neck of the beverage container therein a monolithic cap liner located in the interior region, the cap liner includes a disk adhered to the cap, a first seal ring, and a second outermost seal ring arranged to surround the first seal ring, the first seal ring having an annular base appended to the disk and an annular crest arranged to lie at a first distance from the disk to provide the first seal ring with a first profile height, the second seal ring having an annular base appended to the disk and an annular crest arranged to lie at a lesser second distance from the disk to provide the second seal ring with a second profile height that is less than the first profile height associated with the first seal ring, and wherein both seal rings are located on the disk to provide compressive sealing to the substantially flat top surface of the beverage container and wherein the first seal ring annular crest engages the substantially flat top surface of the beverage container and is compressed by contact with the substantially flat top surface prior to the second seal ring annular crest contacting the substantially flat top surface of the beverage container.

34. The closure of claim 33, wherein the first seal ring includes a radially inwardly facing surface and a radially outwardly facing surface and the second seal ring includes a radially inwardly facing surface arranged to lie in confronting relation to and merge with the radially outwardly facing surface of the first seal ring.

35. The closure of claim 34, wherein at least one of the surfaces has a frustoconical shape.

36. The closure of claim 34, wherein each of the surfaces has a frustoconical shape.

37. The closure of claim 34, wherein at least one of the surfaces has a convex shape.

38. The closure of claim 34, wherein each of the surfaces has a convex shape.

39. The closure of claim 34, wherein the annular crest of each of the first and second seal rings is flat.

40. The closure of claim 33, wherein the first seal ring includes a radially outwardly facing surface, the second seal ring includes a radially inwardly facing surface arranged to lie in confronting relation to the radially outwardly facing surface of the first seal ring, and at least one of the surfaces includes a first portion having a cylindrical shape positioned to lie adjacent to the disk and a second portion having a frustoconical shape positioned to lie in spaced-apart relation to the disk.

41. The closure of claim 33, wherein the first seal ring includes a radially outwardly facing surface, the second seal ring includes a radially inwardly facing surface arranged to lie in confronting relation to the radially outwardly facing surface of the first seal ring, and each of the surfaces includes a first portion having a cylindrical shape positioned to lie adjacent to the disk and a second portion having a frustoconical shape positioned to lie in spaced-apart relation to the disk.

* * * * *